US007817499B2

(12) United States Patent
Solhjoo et al.

(10) Patent No.: US 7,817,499 B2
(45) Date of Patent: Oct. 19, 2010

(54) CO END OF LIFE TIMING CIRCUIT

(75) Inventors: Azadeh Solhjoo, Roslyn Heights, NY (US); Theodore A. White, Norwalk, CT (US)

(73) Assignee: Honeywell International Inc., Morristown, NJ (US)

( * ) Notice: Subject to any disclaimer, the term of this patent is extended or adjusted under 35 U.S.C. 154(b) by 96 days.

(21) Appl. No.: 11/956,674

(22) Filed: Dec. 14, 2007

(65) Prior Publication Data

US 2009/0154299 A1 Jun. 18, 2009

(51) Int. Cl.

| | |
|---|---|
| ***G04B 47/00*** | (2006.01) |
| ***G08B 1/00*** | (2006.01) |
| ***G08B 29/00*** | (2006.01) |
| ***G08B 17/00*** | (2006.01) |

(52) U.S. Cl. ..... 368/10; 368/11; 368/12; 368/73; 340/309.4; 340/506; 340/584; 340/632

(58) Field of Classification Search ..... 368/10, 368/11, 12, 28, 29, 73, 109; 340/539.26, 340/539.27, 577, 584, 632, 309.16, 309.4, 340/506, 628, 309.7; 702/187

See application file for complete search history.

(56) References Cited

U.S. PATENT DOCUMENTS

| | | | | |
|---|---|---|---|---|
| 5,117,096 | A * | 5/1992 | Bauer et al. | 235/375 |
| 5,568,129 | A * | 10/1996 | Sisselman et al. | 340/628 |
| 5,798,694 | A * | 8/1998 | Reber et al. | 340/540 |
| 5,815,075 | A * | 9/1998 | Lewiner et al. | 340/506 |
| 6,294,997 | B1 * | 9/2001 | Paratore et al. | 340/572.1 |
| 6,664,887 | B1 * | 12/2003 | Fuchs | 340/309.16 |
| 6,712,276 | B1 * | 3/2004 | Abali et al. | 235/492 |
| 6,795,376 | B2 * | 9/2004 | Quine | 368/10 |
| 6,826,119 | B2 * | 11/2004 | Fortune | 368/10 |
| 7,050,991 | B2 * | 5/2006 | Ogasawara | 705/22 |
| 7,091,861 | B2 * | 8/2006 | Schmidtberg et al. | 340/572.1 |
| 7,212,955 | B2 * | 5/2007 | Kirshenbau | 702/187 |
| 7,403,128 | B2 * | 7/2008 | Scuka et al. | 340/632 |
| 7,495,558 | B2 * | 2/2009 | Pope et al. | 340/572.1 |
| 2002/0085453 | A1 * | 7/2002 | Fortune | 368/100 |
| 2003/0020619 | A1 * | 1/2003 | Winters et al. | 340/632 |
| 2004/0100380 | A1 * | 5/2004 | Lindsay et al. | 340/540 |
| 2004/0217857 | A1 * | 11/2004 | Lennartz et al. | 340/514 |
| 2004/0246819 | A1 * | 12/2004 | Quine | 368/10 |
| 2005/0248455 | A1 * | 11/2005 | Pope et al. | 340/539.27 |
| 2006/0144938 | A1 * | 7/2006 | David | 235/385 |
| 2007/0069904 | A1 * | 3/2007 | DeLuca et al. | 340/628 |
| 2007/0214055 | A1 * | 9/2007 | Temko | 705/22 |

* cited by examiner

*Primary Examiner*—Vit W Miska
(74) *Attorney, Agent, or Firm*—Husch Blackwell Welsh Katz

(57) ABSTRACT

A system for indicating an end of a life cycle time period for a device which may include a sensor device or detector for measuring an environmental condition. A control device communicates with the device and includes a programmable timing mechanism for measuring a life cycle time period. The control device initiates an end of life cycle indicator such as a fault message after the life cycle time period has elapsed. The life cycle time period may be measured from a date of manufacture of the device. The life cycle time period may also be measured from a date of installation of the device when the date of manufacture of the sensor device is unknown. In the case of sensor devices or detectors an environmental condition for measuring by the detector may include carbon monoxide levels in an enclosed area where the device is a respective carbon monoxide detector.

10 Claims, 1 Drawing Sheet

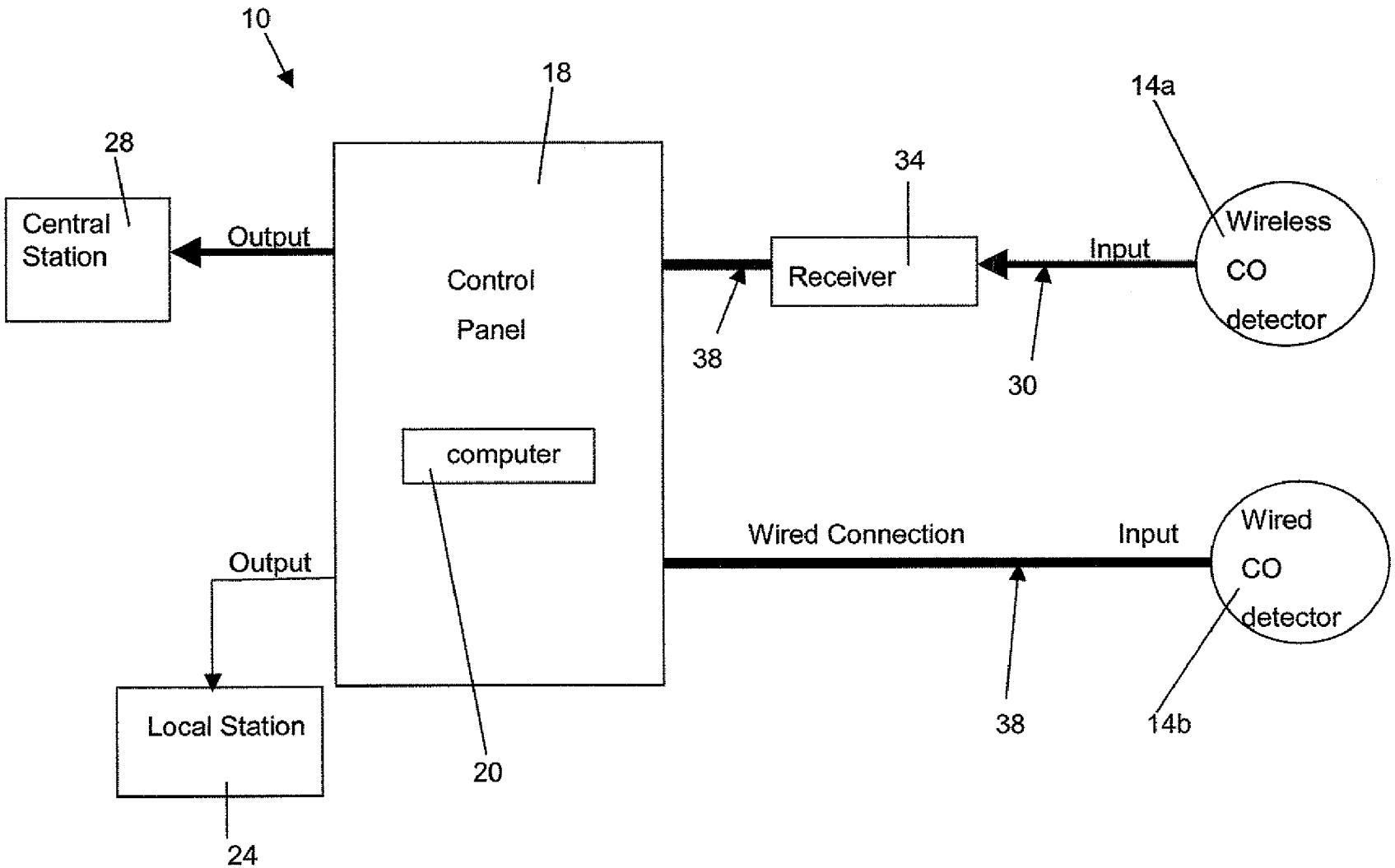
Wireless CO detector
14a
Input
30
34
Receiver
38
Wired CO detector
14b
Input
38
Wired Connection
18
Control Panel
computer
20
10
Output
28
Central Station
Output
Local Station
24

CO END OF LIFE TIMING CIRCUIT

FIELD OF THE INVENTION

The present invention relates to a system for indicating the end of a life cycle of a sensor device, and more specifically, the sensor device measures an environmental condition.

BACKGROUND OF THE INVENTION

Typical sensor devices may be connected to alarm systems which include a control panel for managing multiple sensor devices. The sensor devices may include carbon monoxide (CO) sensors or sensing elements, smoke sensors, or heat sensors. In the case of a CO sensor device or CO detector, the CO sensing element in the CO sensor device typically has a sensing life of 6 years from the date of manufacture, after which, the reliability of the sensing element cannot be assured. Therefore, the CO sensor device may have a built in timer or timing mechanism to indicate a trouble condition after 6 years of operation.

However, a disadvantage of this solution is that the operation time does not take into account the time period from manufacture of the device to the beginning of the time period of operation. Thus, the sensing life of the CO sensing element may not be the full 6 year time period. Therefore, present timing mechanisms for sensor devices are inaccurate and fail to consider the true life cycle of the sensor device.

Alternatively, known devices other than sensor devices may include life cycle indicators, such as a car battery, or a cell phone battery, or industrial equipment or machinery, and more particularly, indicators as part of car dashboard for alerting the driver of a multiplicity of problems and warning of end of life cycle issues with car equipment and systems, are all examples of life cycle indicators. However, most of these devices or systems do not provide an indicator to the user when the user is both local to the monitored device and away or remote with respect to the monitored device. Further, even when the user is remote from the device, the device or systems do not provide an accurate assessment of the life cycle of the monitored device nor do they provide multiple calculation options for assessing and indicating the life cycle end of the monitored device.

Therefore, a need exists for a device timing mechanism which more accurately calculates a life cycle time period and also provides multiple calculation options. Particularly, it would be desirable to provide a sensor device timing mechanism which accurately calculates a life cycle time period and initiates a signal communicating an end of life cycle. More specifically, it would be desirable to provide a sensor device timing mechanism which accounts for the time period from manufacture of the sensor device to the installation of the sensor device, and thereby reflects the true life cycle of the sensor device. Additionally, it would be desirable for the desired timing mechanism to be integrated with an alarm system to indicate at a control panel the end of the life cycle of the sensor device.

SUMMARY OF THE INVENTION

In an aspect of the invention, a method indicates the end of a life cycle of a device, comprising: installing a device communicating with a control device; instructing a user to enter a specified date; entering the specified date in a programmable timing mechanism of the control device; calculating a life cycle time period beginning from the specified date; and initiating an end of life cycle indicator after the life cycle time period has elapsed.

In a related aspect, the specified date is a date of manufacture of the device, and in an alternative embodiment, the specified date is a date of installation of the device. Further, the specified date may be a date of manufacture of the device and when the date of manufacture is not entered, the programmable timing mechanism defaults to entering a date of installation. Alternatively, the method may further include programming the programmable timing mechanism for calculating the life cycle time period.

In a related aspect, the method further includes: programming the programmable timing mechanism to calculate the life cycle time period beginning from the date of manufacture of the device; automatically inputting a date of installation of the device into the programmable timing mechanism when the date of manufacture is not entered; and calculating the life cycle time period beginning from the date of installation of the device. Alternatively, the device may be a sensor device and the method may further include measuring an environmental condition using the sensor device.

In another aspect of the invention, a control device communicates with at least one remote device. The control device includes a programmable timing mechanism including a computer program embodied in a computer readable medium readable by a computer. The programmable timing mechanism measures a life cycle time period of the remote device and initiates an end of life cycle indicator after the life cycle time period has elapsed. A date of manufacture of the remote device entered into the computer program for calculating the life cycle time period measured from the date of manufacture or being measured from a date of installation of the remote device is automatically entered by the computer program when the date of manufacture is not entered. The remote device may include at least one sensor device.

In a related aspect, the life cycle indicator is included in the control device, and the control device further includes a plurality of remote sensing devices; and a plurality of environmental conditions measured by the plurality of remote sensor devices, respectively. Further, each remote sensor device has a specified life cycle time period. Also, the sensor devices initiates a respective environmental condition indicator included in the control device which relates to each environmental condition.

In another aspect of the invention, a system for indicating the end of a life cycle of a device comprises a control device and a remote device communicating with the control device. A programmable timing mechanism includes a computer program embodied in a computer readable medium readable by a computer included in the control device for measuring a life cycle time period of the remote device from a specified entered date. The programmable timing mechanism initiates an end of life cycle indicator when the life cycle time period has elapsed. The remote device may also be a sensor device. Further, the remote device may be a sensor device for measuring an environmental condition. Additionally, the specified entered date may be a date of manufacture of the remote device. Alternatively, the specified entered date may be a date of installation of the remote device. In another embodiment, the specified entered date may be a date of manufacture of the remote device or when the date of manufacture is not entered, the programmable timing mechanism defaults to entering a date of installation.

In a related aspect, the remote device is a carbon monoxide detector for measuring carbon monoxide levels in an enclosed area. In another embodiment, a plurality of environmental conditions are measured by a respective plurality of sensor devices each having a specified life cycle time period, and the sensor devices initiate a respective environmental condition indicator relating to each environmental condition. Alternatively, the plurality of environmental conditions include carbon monoxide levels, smoke levels, and heat levels in an enclosed area, and the plurality of sensor devices include a carbon monoxide detector, a smoke detector, and a heat detector, respectively. In an alternative embodiment, at least one sensor device is electrically connected to the control device, and at least one sensor device communicates wirelessly with the control device.

BRIEF DESCRIPTION OF THE DRAWINGS

These and other objects, features and advantages of the present invention will become apparent from the following detailed description of illustrative embodiments thereof, which is to be read in connection with the accompanying drawing, in which:

The FIGURE is a block diagram depicting a system for indicating the end of a life cycle of a device according to an embodiment of the present invention which includes a control panel using a computer communicating with CO detectors.

DETAILED DESCRIPTION OF THE INVENTION

Referring to the FIGURE, a system 10 for indicating the end of a life cycle time period of a device may include a multiplicity of sensor devices embodied as a wireless CO detector 14*a* and a wired CO detector 14*b* for measuring CO levels as an embodiment of an environmental condition. A control device is embodied as a control panel 18 and communicates with the CO detectors 14*a*, 14*b* which are remote from the control panel 18. Although the embodiment of the present invention includes sensor devices, which may also include, for example an infrared sensor, the invention may include any kind of device where a life cycle time period is applicable. A programmable timing mechanism embodied as a computer 20 is included in the control panel 18 for measuring a life cycle time period of the CO detectors 14*a*, 14*b* and initiating an end of life cycle indicator embodied as a local fault message at local station 24 and a central fault message at a central station 28 after the life cycle time period has elapsed. The local station message 24 and central station message 28 may include a visual signal or audio signal. In one embodiment, the computer 20 may include a computer program stored in a data storage device such as a hard drive and executed by a computer processor or microprocessor for calculating a life cycle time period. The wireless CO detector 14*a* communicates wirelessly 30 with a receiver 34 which is electrically connected via wire 38 to the control panel 18. The wired CO detector 14*b* is electrically connected via wire 38 to the control panel 18.

In one embodiment of the invention, the life cycle time period is measured from a date of manufacture of the wireless CO detector 14*a* and the wired CO detector 14*b*. For example, the life cycle time period may extend about 70 months from the date of manufacture of the CO detectors 14*a*, 14*b* upon which the control panel 18 initiates the local fault message 24 and the central fault message 28.

In another embodiment of the invention, the date of manufacturer of the CO detectors is unknown or unavailable and thus, the user or installer of the CO detectors 14*a*, 14*b* will not enter any date at the control panel 18 during the installation process of a new sensor device. In this case, the computer 20 automatically defaults to the date of installation using a date and time program currently running in the computer 20. Thus, the life cycle time period is measured from the date of installation of the CO detector. In one instance, the life cycle time period may extend about 58 months from the date of installation of the sensor detectors. Thus, the life cycle time period can be measured from the date of manufacture of the CO detectors or may be measured from the date of installation of the sensor when the date of manufacture is unavailable or unknown and thus not entered into the computer during installation of the new sensor device.

In another embodiment of the invention, a multiplicity of sensor devices may include sensing other environmental condition, simultaneously or in lieu of the CO detectors, 14*a*, 14*b*. For example, smoke levels and heat levels in an enclosed area may be monitored by one or more smoke detectors and a heat detectors, respectively, each having a specified life cycle time period, and the sensor devices initiate a respective environmental condition indicator at the control panel 18 relating to each environmental condition. In one instance, the control panel 20 may include different zones for differing sensor devices, such as zone types for CO, smoke, and heat detectors. Alternatively, in another embodiment, different zones can apply to floors in a building, or different buildings in a multi building complex which has multiple control panels. For example, when the CO detectors 14*a*, 14*b* are first enrolled in a CO zone, the installer enters the manufacture date code of the CO detector into the computer 20. As a result, a time period of seventy (70) months, which is two months less than the six year sensing element life time, is computed from the manufacturing date of the CO detectors 14*a*, 14*b* to determine the life cycle time period or end of life cycle (for example, a software counting loop) timer. Upon elapsing of the life cycle time period or timing out (for example, exiting the counting loop) the control panel 18 initiates the local fault message 24 and the central fault message 28 to indicate, for example, that one or more CO detectors 14*a*, 14*b* need replacement. If a manufacturing date code is not entered, a date of installation may be entered and the control panel 18 will compute a life cycle time period of fifty eight (58) months, which is fourteen months prior to the six year sensing element life time and thus includes an approximation of a one year time period from manufacture to sale/installation. As discussed above, upon elapsing of fifty eight months time, the control panel 18 initiates the local fault message 24 and the central fault message 28 to indicate, for example, that one or more CO detectors 14*a*, 14*b* need replacement. Thereby, the user has sixty (60) days to replace or arrange to replace the CO detector(s) 14*a*, 14*b* before a trouble or fault alarm appears at the control panel initiated by the CO detectors because the full six year sensing life has elapsed, and before the CO detector(s) 14*a*, 14*b* themselves initiate an alarm such as a periodic warning chirp.

Referring to the FIGURE, in operation, a method for indicating an end of life cycle of the CO detectors 14*a*, 14*b* includes the sensor devices embodied as the wireless and wired CO detectors 14*a*, 14*b* measuring the CO levels in the environment, for example, the enclosed space of a home or an office space. A user or installer installs a new CO detector such as the wireless or wired CO detectors 14*a*, 14*b* shown in the FIGURE which communicate with the control panel 18. The user is instructed by the control panel to enter a specified date which in the present embodiment is the manufacture date of the detector 14*a*, 14*b*. The user enters the manufacture date into a programmable timing mechanism in the computer 20 of the control device 18. If the manufacture date of the detector is unknown or unavailable, the user does nothing (the computer waits a preprogrammed amount of time) and the computer automatically enters the date of installation as a default. A computer program calculates the life cycle time period beginning from the manufacture date or the installation date.

Thereafter, the control panel 18 will initiate the life cycle indicator, i.e., the central fault message 28 and/or the local fault message 24 after the life cycle time period has elapsed. Other local and central fault messages may include the CO detectors 14*a*, 14*b* emitting a sound when the full life cycle time period has elapsed a specified time after the fault messages are communicated. The fault message in no way interferes with the sending of an alarm signal indicating CO detection and thus a safety risk, to the local and central stations, as well as, other monitoring stations for notifying emergency personnel.

Additionally, the inputted manufacture date may be entered into a user interface communicating with the computer 20. A timing mechanism program embodied in computer readable medium in the computer begins calculation of the life cycle time period once either the date of manufacture or the date of installation is automatically entered by the computer. Thus, for example, when the manufacture date code of the CO detector in entered into the computer 20, a time period of seventy (70) months is computed from the manufacturing date of the CO detectors 14*a*, 14*b* to determine the life cycle time period, and upon elapsing of which time the control panel 18 initiates the local fault message 24 and the central station alarm 28 to indicate that one or more CO detectors 14*a*, 14*b* need replacement. Likewise, if the manufacturing date code is not entered because it is unknown or unavailable, the date of installation is automatically entered by the computer and the control panel 18 will compute the life cycle time period of fifty eight (58) months. As discussed above, upon elapsing of fifty eight months time, the control panel 18 initiates the local fault message 24 and the central fault message 28 to indicate that one or more CO detectors 14*a*, 14*b* need replacement. Thereby, the user will replace the respective CO detector(s) 14*a*, 14*b* within the sixty (60) day time period before a trouble or fault alarm appears at the control panel or at the central station alarm 28 and/or the local alarm 24, and before the CO detector(s) 14*a*, 14*b* themselves initiate an alarm.

Thus, when the life cycle time period begins from the date of manufacture of the CO detector, the computer 20 calculates the life cycle time period of the CO detectors 14*a*, 14*b*. When the life cycle time period has elapsed, the central station alarm 28 and the local alarm 24 are initiated signaling that the life cycle time period has elapsed, and therefore that one or more of the CO detectors 14*a*, 14*b* need replacement.

While the present invention has been particularly shown and described with respect to preferred embodiments thereof it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. A system for indicating the end of a life cycle of a device, comprising:

a control device;

a user interface of the control device that accepts entry of a specified date;

a remote device wired or wirelessly coupled to communicate with the control device; and a programmable timing mechanism includes a computer program embodied in a computer readable medium readable by a computer included in the control device that calculates a life cycle time period of the remote device during installation of the remote device from the specified date, and the programmable timing mechanism initiating a remote end of life cycle indicator upon expiration of the life cycle time period and the programmable timing mechanism automatically calculates the life cycle time period from a date of installation in the absence of entry of the specified date through the user interface.

2. The system of claim 1, wherein the remote device is a sensor device.

3. The system of claim 1, wherein the remote device is a sensor device for measuring an environmental condition.

4. The system of claim 1, wherein the specified entered date is a date of manufacture of the remote device.

5. The system of claim 1, wherein the specified entered date is a date of installation of the remote device.

6. The system of claim 1, wherein the specified entered date is a date of manufacture of the remote device or when the date of manufacture is not entered, the computer program defaults to entering a date of installation.

7. The system of claim 1, wherein the remote device is a carbon monoxide detector for measuring carbon monoxide levels in an enclosed area.

8. The system of claim 1, wherein the remote device further comprises a respective plurality of environmental sensor devices each sensor device of the plurality of sensor devices having a specified life cycle time period, and the sensor devices initiate a respective environmental condition indicator relating to each environmental condition sensed by the sensor.

9. The system of claim 8, wherein the plurality of environmental conditions include carbon monoxide levels, smoke levels, and heat levels in an enclosed area, and the plurality of sensor devices include a carbon monoxide detector, a smoke detector, and a heat detector, respectively.

10. The system of claim 8, wherein at least one sensor device is electrically connected to the control device, and at least one sensor device communicates wirelessly with the control device.

* * * * *